United States Patent [19]

Schneider et al.

[11] Patent Number: 4,644,343

[45] Date of Patent: Feb. 17, 1987

[54] Y-SLOT WAVEGUIDE ANTENNA ELEMENT

[75] Inventors: Wayne A. Schneider, Kent; Margaret S. Morse, Renton; John Tjoelker, Seattle, all of Wash.

[73] Assignee: The Boeing Company, Seattle, Wash.

[21] Appl. No.: 781,943

[22] Filed: Sep. 30, 1985

[51] Int. Cl.[4] ..... H01Q 13/10

[52] U.S. Cl. ..... 343/767; 343/771

[58] Field of Search ..... 343/762, 767, 768, 769, 343/770, 771, 789, 841, 729

[56] References Cited

U.S. PATENT DOCUMENTS

| | | | |
|---|---|---|---|
| 2,507,528 | 5/1950 | Kandoian | 343/767 |
| 2,557,951 | 6/1951 | DeRosa et al. | 343/770 |
| 2,761,137 | 8/1956 | Van Atta et al. | 343/771 |
| 2,937,373 | 5/1960 | Carter | 343/771 |
| 3,066,293 | 11/1962 | Davis | 343/767 |
| 3,696,433 | 10/1972 | Killion et al. | 343/770 |
| 4,242,685 | 12/1980 | Sanford | 343/770 |
| 4,443,802 | 4/1984 | Mayes | 343/729 |

OTHER PUBLICATIONS

*IRE Transactions on Antennas and Propagation*, "Circularly Polarized Slot Radiators", pp. 31–36, Jan. 1956.

*Primary Examiner*—Marvin L. Nussbaum

*Attorney, Agent, or Firm*—Christensen, O'Connor, Johnson & Kindness

[57] ABSTRACT

Disclosed is an antenna element that is defined by a substantially Y-shaped slot (22) formed in the broad face (12) of a section of dielectrically-filled waveguide (10). Various design parameters including leg length, leg width and angle formed between the legs permit the antenna element to be configured for circularly polarized radiation of a controlled portion of the electromagnetic energy that propagates along the waveguide.

16 Claims, 9 Drawing Figures

INSERTION LOSS dB
3.0
2.0
1.0
0.0
-3.0
-1.17
-.65
-.43
-.31
-.23
-.17
-.14
-.12
0.50
0.60
0.70
0.80
0.90
Y-SLOT LEG LENGTH, INCHES

INSERTION PHASE SHIFT DEGREES
60
50
40
30
20
10
0
47°
34°
26°
20°
15°
11°
7.5°
6°
0.50
0.60
0.70
0.80
0.90
Y-SLOT LEG LENGTH, INCHES

Fig. 7.
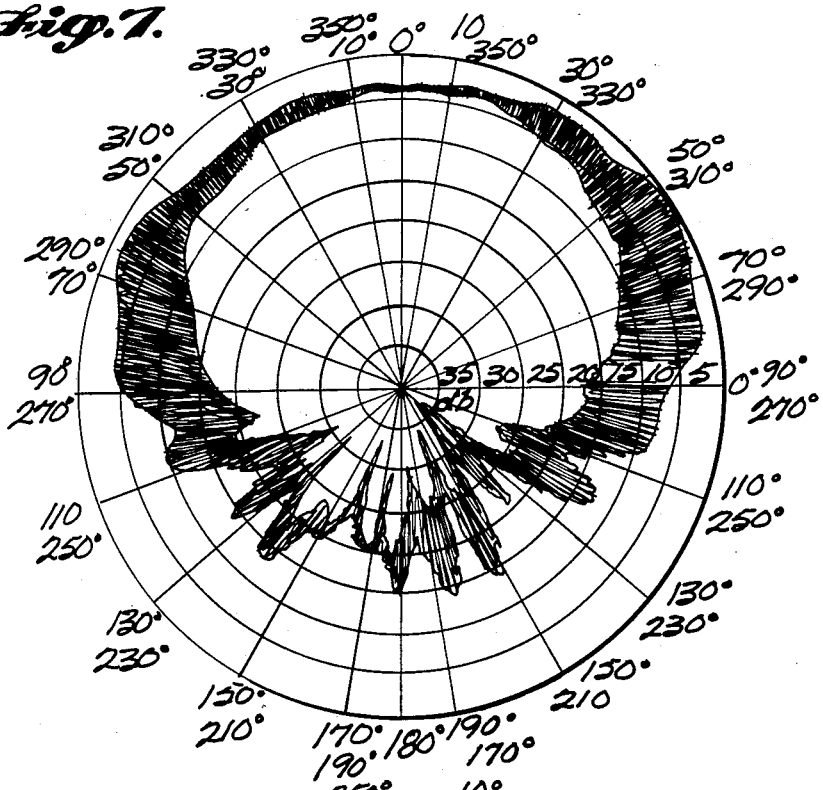
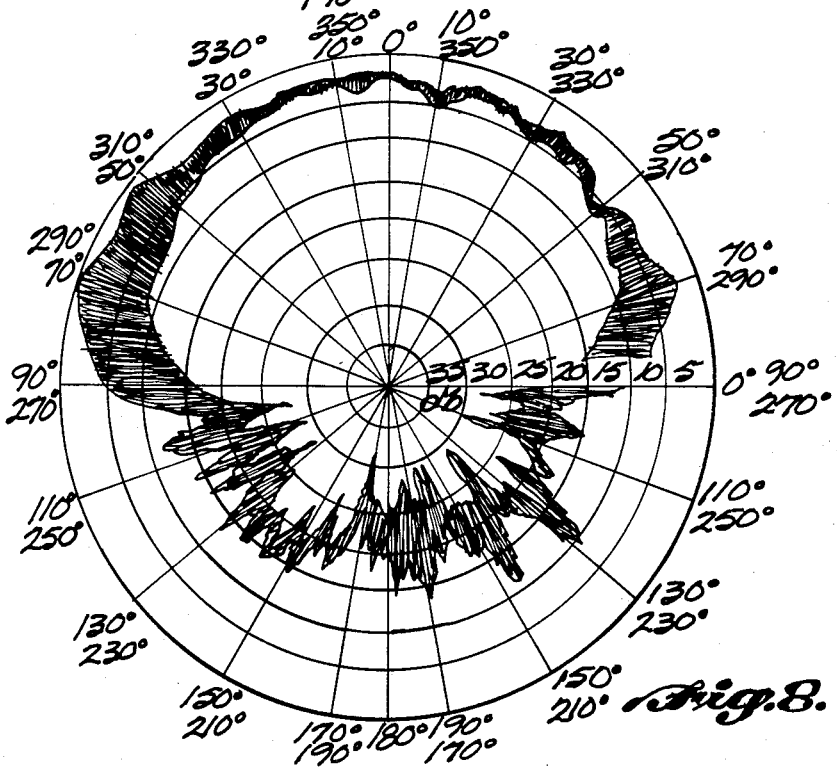
Fig. 8.

Y-SLOT WAVEGUIDE ANTENNA ELEMENT

BACKGROUND OF THE INVENTION

This invention relates to antenna structure for radiation of electromagnetic energy that is propagating along guided wave structure. More specifically, this invention relates to an antenna element for circularly polarized radiation of a predetermined portion of an electromagnetic wave that is propagating along a waveguide.

Numerous communications, tracking and telemetry systems require antenna elements for radiation of circularly polarized electromagnetic waves. In a wide range of relatively high frequency transmission (and reception) systems, the preferred arrangement is one in which the electromagnetic energy to be radiated propagates along a waveguide and the antenna element is formed as an integral part of the waveguide. In the prior art, attempts have been made to provide such structure by machining openings in the broad face of an air-filled rectangular waveguide with each opening being either circular in geometry or being a "cross-slot" that is formed by two narrow slots that intersect one another to form four equal-length orthogonally extending arms. As is disclosed in a technical article entitled "Circularly Polarized Radiators," by A. J. Simmons, *IRE Transactions of Antenna and Propagation,* pages 31–38, January 1956, such circular slots and cross-slot arrangements will radiate electromagnetic energy of circular or near-circular polarization when the center of the slot is positioned in the broad face of the waveguide at a point that lies between the centerline of the waveguide and one of the waveguide sidewalls.

Although prior art circular and cross-slot waveguide antenna elements can be satisfactory in some situations, various problems and drawbacks can be encountered. For example, in aerospace applications and others, size and weight constraints often exist that make it impossible or at least undesirable to utilize air-filled waveguides. In addition, in such applications, it is often necessary to configure the antenna so that the broad face of the waveguide that contains one or more antenna elements either forms or conforms to the outer surface of an aircraft, missile or other type of aerospace vehicle. Even if it is possible to configure an air-filled waveguide to the desired contour or shape, relatively complex and costly fabrication and/or forming techniques are required.

Although it is well known that the size of a rectangular waveguide for use at any particular band of frequencies can be substantially reduced by filling the interior of the waveguide with a material that exhibits a dielectric constant greater than that of air, the prior art circular and cross-slot antenna elements have not proven to be fully satisfactory in such an arrangement. In particular, circular slots in a dielectrically-filled rectangular waveguide exhibit satisfactory circular polarization, but cannot be configured for radiation of more than approximately 30% of the electromagnetic energy that propagates along the waveguide. On the other hand, when cross-slots are provided in the broad face of a dielectrically-filled rectangular waveguide, on the order of 95% of the incident electromagnetic energy can be radiated, but the radiation becomes highly elliptical. There are many applications in which the radiation characteristics of the prior art slots of circular and cross-slot geometry cannot meet system design constraints. Further, there are many applications which require that only a controlled portion of incident electromagnetic energy be radiated, with the remaining portion of the energy propagating beyond the antenna element for radiation by other antenna elements (array applications) or for utilization by other components of a microwave system.

SUMMARY OF THE INVENTION

In accordance with this invention, Y-shaped slots are formed in the broad face of a waveguide for radiation of circularly polarized electromagnetic energy. Good circularity (axial ratio of less than 3 decibels) is maintained as long as the Y-shaped slot lies in a half-plane of the broad face of the waveguide (i.e., does not extend across the centerline of the broad face). Relative to the direction in which electromagnetic energy propagates along the waveguide, right-hand circular polarization is obtained when the Y-shaped slot is placed in the left-hand half-plane of the waveguide broad face and left-hand circular polarization is obtained when the Y-shaped slot is positioned in the right-hand half-plane of the broad face of the waveguide.

To obtain maximum radiation and minimum ellipticity, the Y-shaped slots are positioned so that one leg of the slot is perpendicular to the sidewall of the waveguide. In the currently preferred embodiments that are configured for maximum radiation efficiency, the legs of the slots are of equal length, with the angle of intersection between the legs being 120° and with the width of each leg being on the order of 0.03 wavelengths.

In accordance with one important aspect of the invention, the length of the legs of the Y-shaped slot can be established to control the amount of radiated energy. In particular, when it is desired that only a predetermined portion of the energy propagating along the waveguide be radiated, a Y-shaped slot having legs that are shorter than the maximum allowable length can be employed. In addition, the portion of the incident energy that is radiated can be decreased by controlling the angle of intersection between the two legs of the Y-shaped slot that lie nearest most the centerline of the broad face of the waveguide. Even further, with respect to Y-shaped slots that are not dimensioned for maximum radiation efficiency, the amount of energy radiated can be increased by forming a central opening that alters the region of the Y-shaped slot that surrounds the point at which the legs intersect one another. In particular, in one disclosed embodiment of the invention, the central portion of each Y-shaped slot is defined by a circle that exhibits a radius less than the slot leg length. Thus, in this embodiment of the invention, the antenna element is a small circular opening having three rectangular legs extending radially outward therefrom.

Since the radiation efficiency of antenna elements configured in accordance with the invention can be controlled by several parameters (leg length, angle of inclusion between two of the legs, and the inclusion of a circular central opening), the invention is especially advantageous in situations in which it is desired or necessary to radiate a predetermined portion of the incident energy while allowing the unradiated portion to propagate along the waveguide for radiation by an additional Y-shaped slot (array applications) or for other purposes. With respect to arrays or other applications in which the size of the antenna element is important, sections of a dielectrically-filled waveguide that include a Y-shaped slot configured in accordance with the invention and an adequate length of waveguide feedline occupy a volume approximately 0.6 wavelength wide, 0.7 wavelength long, and 0.05 wavelength thick.

In accordance with another important aspect of the invention, the various embodiments of the invention that are described herein can be fabricated by application of conventional printed circuit and plating technology. For example, realizations of the invention for S- and C-Band have been constructed of commercially-available printed circuit material that includes a thin layer on each face of a tetrafluoroethylene fluorocarbon resin/fiberglass dielectric material (with tetrafluoroethylene, or TFE, being the generic name for the material that is manufactured under the trademark TEFLON). In realizing the invention with such printed circuit material, the copper clad printed circuit material is cut into strips of the proper width and the Y-shaped slot or slots are etched in the printed circuit material conductive layer using conventional printed circuit photolithographic techniques. If the antenna being formed is to be curved or contoured, the printed circuit board material can then be rolled or otherwise formed to the desired contour. Once these operations are complete, conventional plating or metal deposition techniques are utilized to form the waveguide sidewalls.

BRIEF DESCRIPTION OF THE DRAWING

These and other aspects and advantages of the invention can be better understood by reference to the following description, taken in conjunction with the drawing, in which:

FIG. 7 depicts a rotating linear E-plane radiation pattern for a typical embodiment of the invention; and FIG. 8 illustrates a rotating linear H-plane radiation pattern that corresponds to the E-plane radiation pattern shown in FIG. 6.

DETAILED DESCRIPTION

Figure 1:
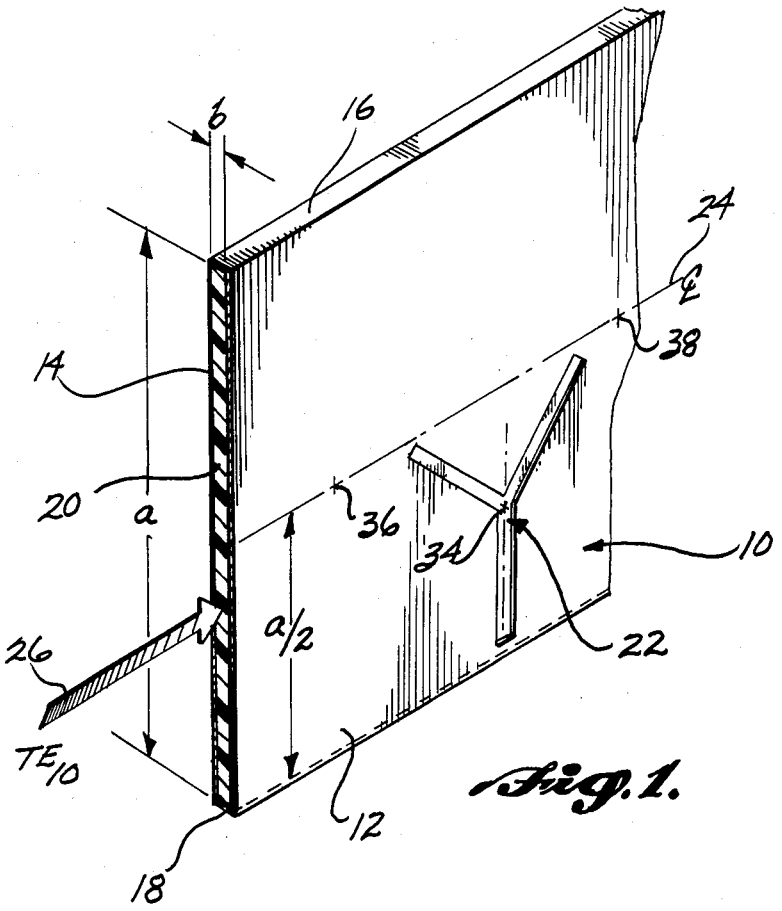
FIG. 1 is an isometric view of a section of dielectrically-filled rectangular waveguide that includes a Y-slot antenna element that is configured in accordance with this invention.

FIG. 1 illustrates a section of dielectrically-filled waveguide 10 that is configured to form an antenna element in accordance with this invention. As is known in the art, dielectrically-filled waveguide 10 is a rectangular duct that includes two oppositely disposed conductive broad faces 12 and 14 and two oppositely disposed conductive sidewalls 16 and 18, with a dielectric material 20 filling the interior region of the waveguide. The radiating element that is formed in accordance with the invention is a substantially Y-shaped slot 22 that is positioned to one side of the axial centerline of a broad face of the waveguide (12 in FIG. 1) and extends through the conductive broad face. Each leg of Y-shaped slot 22 is substantially equal in length with one of the legs being substantially perpendicular to a sidewall of the dielectrically-filled waveguide 10 (sidewall 18 in FIG. 1). Further, when dimensioned for maximum radiation, the angle of inclusion between each pair of legs is 120° and each leg is approximately 0.4 wavelengths (free space) long.

When electromagnetic energy propagates along waveguide 10 ($TE_{10}$ mode) in the direction indicated by arrow 26 of FIG. 1, the substantially Y-shaped slot 22 radiates a left-hand circularly polarized electromagnetic wave. If the electromagnetic energy that propagates through waveguide 10 travels in a direction opposite to that indicated by arrow 26, a right-hand circularly polarized electromagnetic wave is radiated. Similarly, if the substantially Y-shaped slot 22 is formed in the opposite half-plane of broad face 12 of FIG. 1 (i.e., on the other side of axial centerline 24) and electromagnetic energy propagates through the waveguide 10 in the direction indicated by arrow 26, a right-hand circularly polarized wave is radiated. In view of these characteristics, it can be recognized that, in applications in which the invention is utilized as a receiving antenna, an incident wave of right-hand circularly polarized electromagnetic energy will generate an electromagnetic signal in waveguide 10 that propagates in one direction, while an incident left-hand circularly polarized electromagnetic wave will give rise to a signal in waveguide 10 that propagates in the opposite direction. Thus, when an eliptically polarized electromagnetic wave is incident on a substantially Y-shaped antenna element of the invention, the left and right-hand circularly polarized components will be separated into two signals that travel along waveguide 10 in opposite directions.

Figure 2:
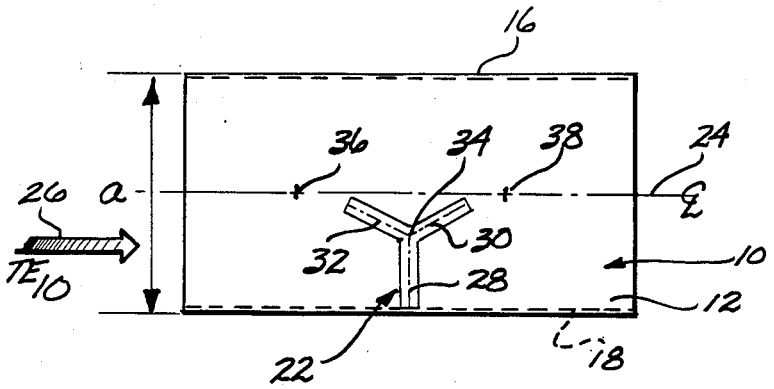
FIG. 2 is a plan view of a section of dielectrically-filled waveguide that illustrates the preferred configuration of the invention for situations in which one or more antenna elements are configured for maximum radiation efficiency.

With reference to FIGS. 1 and 2, the axial centerlines (28, 30 and 32 in FIG. 2) of the three legs of the substantially Y-shaped slot 22 intersect at a point 34 on waveguide broad face 12. In the practice of the invention, intersection 34 is positioned so that an equal leg length realization of substantially Y-shaped slot 22 can be formed in broad face 12 with the substantially Y-shaped slot 22 extending between axial centerline 24 and the interior surface of sidewall 18. In this regard, in currently preferred embodiments of the invention, the distance between intersection 34 of substantially Y-shaped slot 22 at the inner surface of sidewall 18 is 0.303a, where a is the width of broad face 12 of waveguide 10. Although this dimension has resulted in maximum power radiation relative to those realizations of the invention that have been constructed and tested, in some situations it may be advantageous to slightly vary the position of intersection 34 so that maximum power is radiated at the frequency of interest (design frequency).

In the currently preferred embodiments of the invention, the width of each leg of the substantially Y-shaped slot 22 is $0.037\lambda$, where $\lambda$ is the free space wavelength of the radiated signal. It has been empirically determined that this particular width dimension provides maximum power radiation and that a narrower dimension can be employed in situations wherein the substantially Y-shaped slot is not configured for maximum power radiation. As shall be realized upon understanding the various embodiments of the invention that are disclosed herein, the width of the legs of substantially Y-shaped slot 22 is one of several design parameters that allow the invention to be utilized in applications in which a predetermined portion of the energy propagating through waveguide 10 is to be radiated with substantially all of the nonradiating energy continuing to travel in the direction of propagation.

Figure 3A:
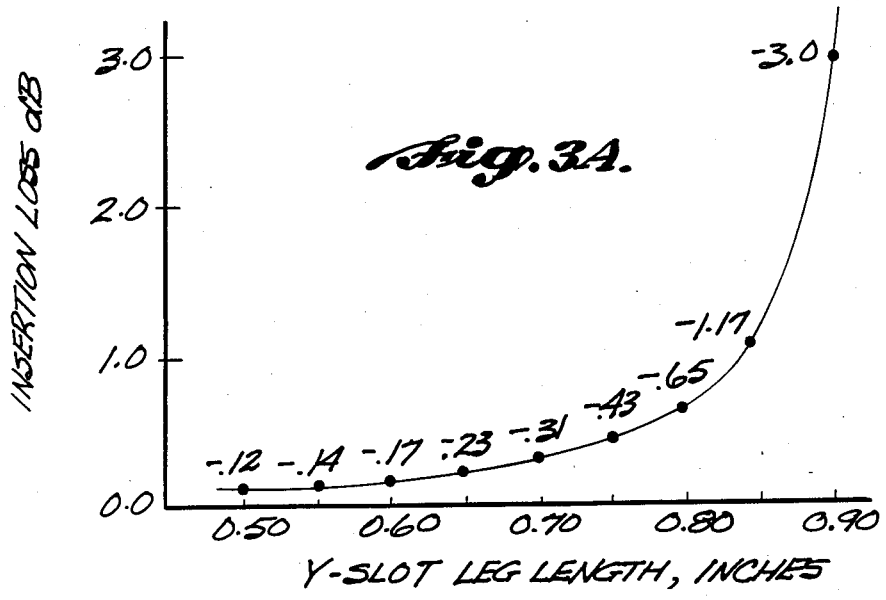
FIGS. 3A and 3B indicate the radiation characteristics of Y-slot antennas constructed in accordance with the invention, with FIG. 3A depicting insertion loss (and hence the amount of power radiated) as a function of FIG. 3B depicting insertion phase shift as a Y-element leg length and function of Y-element leg length.

The primary design parameter utilized to control the amount of energy radiated by a substantially Y-shaped slot 22 of this invention is leg length. In this regard, FIG. 3A illustrates the insertion loss for substantially Y-shaped slots 22 having equal leg lengths of various dimension. The insertion loss data depicted in FIG. 3A was obtained by a conventional test procedure in which incident energy is determined by means of a test probe that is inserted into the interior of waveguide 10 at a point identified by the numeral 36 in FIGS. 1 and 2 and the nonradiated energy is determined by means of a test probe that is inserted into the interior of waveguide 10 at a point identified by the numeral 38 in FIGS. 1 and 2. Since the substantially Y-shaped slots of this invention reflect little of the incident energy, measuring insertion loss is a convenient method of determining the amount of power radiated, with the relationship between insertion loss and the ratio of radiated power to input power being:

$$L = 10 \log (1 - x/x_i) \text{(decibels)}$$

where L denotes the insertion loss, x denotes the radiated power and $x_i$ denotes the input power. In FIG. 3A it can be noted that the insertion loss ranges between approximately 0.1 and 3.0 db as the length of the legs of the substantially Y-shaped slot vary between 0.5 and 0.9 inches. Since the data depicted in FIG. 3A was obtained from an embodiment of the invention that was configured for operation in S-Band (the specific operating frequency being 2209 megahertz), it can be recognized that substantial control over the amount of power radiated by a substantially Y-shaped slot of this invention can be obtained by leg lengths within the range of approximately 0.2 to 0.4 wavelengths.

Figure 3B:
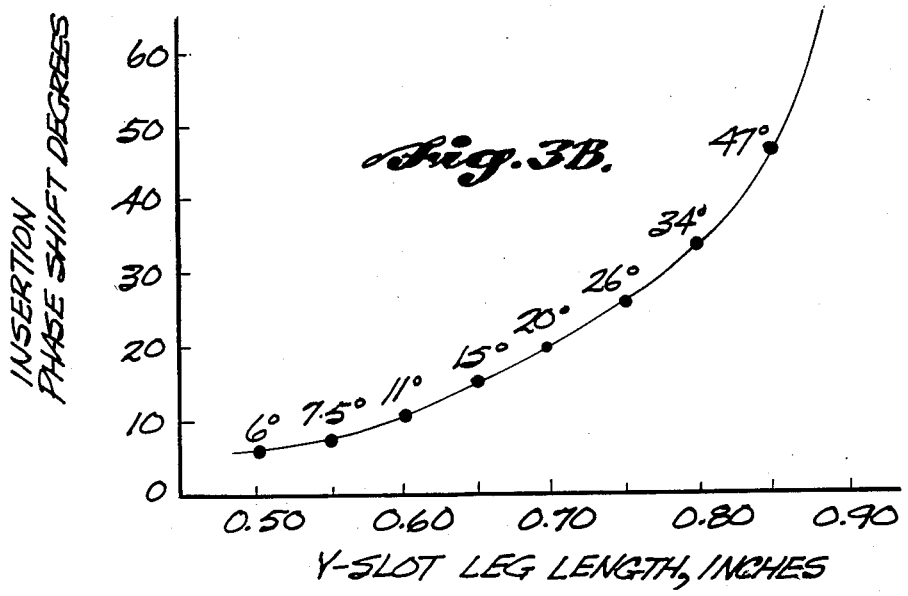

FIG. 3B illustrates the phase shift experienced by the wave that travels past a substantially Y-shaped slot 22, which the phase shift data depicted in FIG. 3B corresponding to the insertion loss data depicted in FIG. 3A. As is shown in FIG. 3B, the insertion phase shift varies between approximately 6° and 47° over the 0.5 to 0.9 inch range in leg length. Both the insertion phase shift of FIG. 3B and the insertion loss of FIG. 3A are believed to be typical of realizations of the invention that are configured in the manner described above and dimensioned for operation at various microwave frequencies. Thus, FIGS. 3A and 3B can serve as design guides in embodying the invention for various applications.

Figure 4:
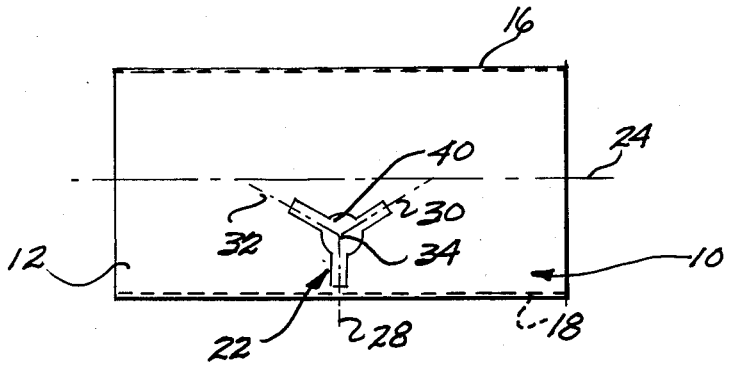
FIG. 4 depicts the broad face of a waveguide that includes an alternative embodiment of the invention in which a central circular opening increases radiation efficiency.

It has been discovered that the amount of power radiated by substantially Y-shaped slot 22 can also be controlled to some degree by altering the configuration of the central portion of the substantially Y-shaped slot. More specifically, as is illustrated in FIG. 4, a substantially Y-shaped slot 22 can include a circular central opening 40 that is centered on intersection 34 and exhibits a radius less than the length of the legs of the substantially Y-shaped slot. The circular central opening 40 increases the amount of power radiated by a substantially Y-shaped slot 22 that has less than maximum leg length (approximately 0.4 wavelength). Thus, in situations in which it is desirable to minimize the area occupied by a substantially Y-shaped slot, a circular opening 40 can be included to obtain the desired amount of radiated power. Alternatively, in some applications it may be necessary to adjust the dimensions of a substantially Y-shaped slot to slightly increase the amount of power radiated after initial fabrication of the antenna element. In such situations, the substantially Y-shaped slot can be configured for radiation of the minimal power required and the power increased to the desired level after initial manufacture and testing of the antenna element being formed by adding a substantially circular central opening 40.

Figure 5:
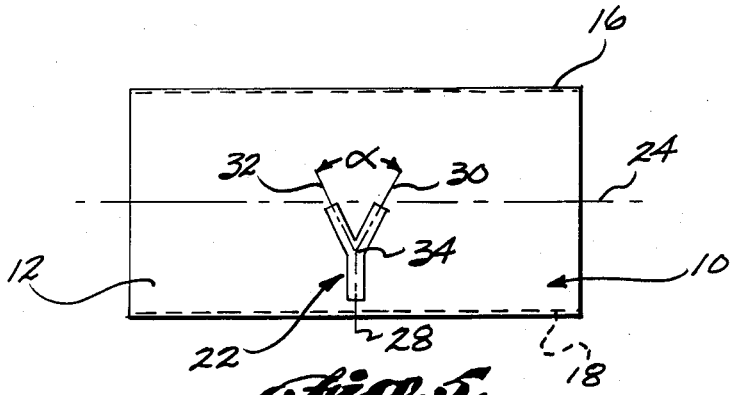
FIG. 5 depicts the broad face of a waveguide which includes a second alternative arrangement of the Y-shaped slots of the invention for controlling the portion of the energy that is radiated.

In addition, it has been determined that the amount of incident energy that is radiated by a substantially Y-shaped slot 22 also is affected by the angle of inclusion between the two legs of the slot that are located nearest most axial centerline 24 of broad face 10. More specifically, and with reference to FIG. 5, it has been determined empirically that the substantially Y-shaped slots of this invention radiate substantially circular polarized waves as long as the angle between the centerlines 30 and 32 of the two legs that extend toward axial centerline 24 of waveguide 10 is within the range of 90° to 150°. In this regard, maximum radiated power is obtained when the angle between each pair of the three legs is 120° and the radiated power decreases in realizations of the invention in which the angle of inclusion defined by centerlines 30 and 32 of FIG. 5 is other than 120°.

Figure 6:
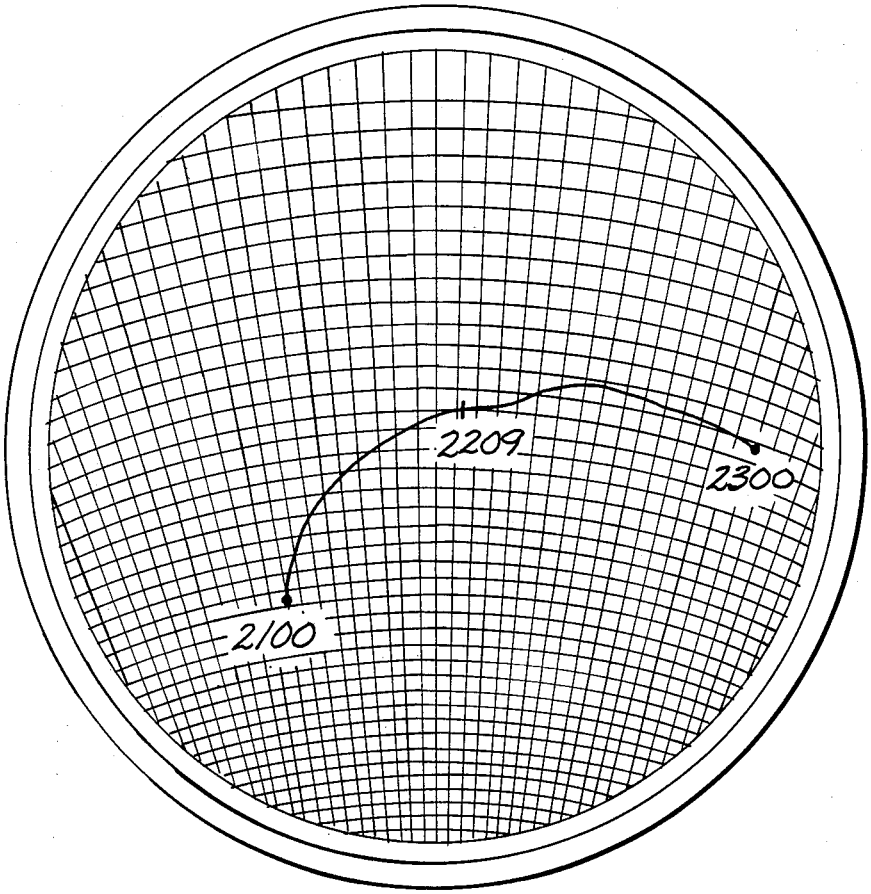
FIG. 6 is an impedance diagram for a typical Y-slot element that is configured in accordance with the invention.

The previously mentioned reflectionless characteristic of substantially Y-shaped slots that are configured in accordance with this invention is illustrated by the impedance chart of FIG. 6, which depicts the voltage standing wave ratio (VSWR) for the S-Band realization of the invention discussed relative to FIGS. 3A and 3B. Since the outer periphery of the impedance chart of FIG. 6 corresponds to a VSWR of 1.5:1 and the center point of the impedance chart corresponds to a perfect impedance match (no signal reflection from slot 22), it can be recognized that substantially no signal reflection occurs at the slot design frequency (2209 megahertz). Further, as also is shown by FIG. 6, the VSWR remains relatively low throughout a range that extends approximately 100 megahertz above and below the design frequency.

FIGS. 7 and 8 respectively illustrate typical E-plane and H-plane radiation patterns for a substantially Y-shaped slot that is configured in accordance with the invention. As can be recognized in view of the symmetry of the radiation patterns depicted in FIGS. 7 and 8, substantially Y-shaped slots configured in accordance with the invention exhibit substantially circular polarization. In this regard, the various realizations of the invention that have been constructed both as single element antennas and as arrays of substantially Y-shaped slots exhibit an axial ratio of less than 3 decibels.

In addition to the above-discussed parametric relationships which allow the invention to be configured either for radiation of substantially all of the incident energy or for radiation of a controlled portion of that energy, the invention is easily and economically fabricated. In particular, the substantially Y-shaped antenna elements of the invention preferably are constructed of conventional printed circuit board material. For example, the S-Band realization of the invention (2209 megahertz), that was discussed relative to FIG. 3 and FIGS. 6 through 8 was constructed from conventional printed circuit board material consisting of 0.25 inch TFE/-fiberglass dielectric board with thin copper layers on each planar surface. In fabricating that realization of the invention, the printed circuit board was machined to a width of 2.97 inches. The substantially Y-shaped slot was then etched in one of the conductive surface layers utilizing conventional printed circuit photolithographic processes, which allow precise dimensioning of the slot. The edge surfaces of the circuit board then were plated with copper utilizing a conventional plating process. During the plating process, the Y-shaped slot was covered with a masking agent that prevented material from being plated on or over the slot. In various other applications that are under development which require that the antenna be curved or otherwise contoured, satisfactory results have been obtained by forming (e.g., rolling) the desired contour prior to plating the sides of the printed circuit board with copper.

The embodiments of the invention in which an exclusive property or privilege is claimed are defined as follows:

1. An antenna element for radiating circularly polarized electromagnetic energy comprising:

a length of dielectrically-filled waveguide, said dielectrically-filled waveguide being rectangular in cross-sectional geometry, having two oppositely disposed parallel conductive broad faces of width a and two oppositely disposed parallel conductive sidewalls of heighth b; and a substantially Y-shaped slot formed in and extending through one of said conductive broad faces of said dielectrically-filled waveguide, said substantially Y-shaped slot being positioned to place substantially all of said substantially Y-shaped slot to one side of the axial centerline of the conductive broad face of said dielectrically-filled waveguide that contains said substantially Y-shaped slot.

2. The antenna element of claim 1 wherein the legs of said substantially Y-shaped slot are of equal length with each leg being between 0.2λ and 0.4λ in length, where λ represents the free space wavelength of the electromagnetic energy to be radiated.

3. The antenna element of claim 1 wherein two legs of said substantially Y-shaped slot extend toward said axial centerline of said broad face of said dielectrically-filled waveguide and the axial centerline of the third leg of said substantially Y-shaped slot is substantially perpendicular to a conductive sidewall of said dielectrically-filled waveguide, the angle defined by the intersection between the centerlines of said two legs that extend toward said axial centerline of said broad face of said dielectrically-filled waveguide being within the range of 90° to 150°.

4. The antenna element of claim 3 wherein said angle defined by the intersection between said two centerlines of said two legs is substantially equal to 120°.

5. The antenna element of claim 4 wherein the width of each leg of said substantially Y-shaped slot is on the order of 0.037λ, where λ represents the free space wavelength of the energy to be radiated.

6. The antenna element of claim 5 wherein the distance between the inner surface of said waveguide sidewall that is perpendicular to said third leg of said substantially Y-shaped slot and the point at which the centerlines of the three legs of said slot intersect is equal to approximately 0.3a.

7. The antenna element of claim 1 wherein said substantially Y-shaped slot includes a central opening that is centered on the intersection of the centerlines of each leg of said substantially Y-shaped slot, said central opening being defined by a circle having a radius that is less than the length of each of said legs of said substantially Y-shaped slot.

8. The antenna element of claim 7 wherein two legs of said substantially Y-shaped slot extend toward said axial centerline of said broad face of said dielectrically-filled waveguide and the axial centerline of the third leg of said substantially Y-shaped slot is substantially perpendicular to a conductive sidewall of said dielectrically-filled waveguide, the angle defined by the intersection between the centerlines of said two legs that extend toward said axial centerline of said broad face of said dielectrically-filled waveguide being within the range of 90° to 150°.

9. The antenna element of claim 8 wherein said angle defined by the intersection between said two centerlines of said two legs is substantially equal to 120°.

10. The antenna element of claim 9 wherein the width of each leg of said substantially Y-shaped slot is on the order of 0.037λ, where λ represents the free space wavelength of the energy to be transmitted.

11. The antenna element of claim 10 wherein the distance between the inner surface of said waveguide sidewall that is perpendicular to said third leg of said substantially Y-shaped slot and the point at which the centerlines of the three legs of said slot intersect is equal to approximately 0.3a.

12. The antenna element of claim 2 wherein two legs of said substantially Y-shaped slot extend toward said axial centerline of said broad face of said dielectrically-filled waveguide and the axial centerline of the third leg of said substantially Y-shaped slot is substantially perpendicular to a conductive sidewall of said dielectrically-filled waveguide, the angle defined by the intersection between the centerlines of said two legs that extend toward said axial centerline of said broad face of said dielectrically-filled waveguide being within the range of 90° to 150°.

13. The antenna element of claim 12 wherein said angle defined by the intersection between said two centerlines of said two legs is substantially equal to 120°.

14. The antenna element of claim 13 wherein the width of each leg of said substantially Y-shaped slot is on the order of 0.037λ, where λ represents the free space wavelength of the energy to be radiated.

15. The antenna element of claim 14 wherein the distance between the inner surface of said waveguide sidewall that is perpendicular to said third leg of said substantially Y-shaped slot and the point at which the centerlines of the three legs of said slot intersect is equal to approximately 0.3a.

16. The antenna element of claim 2 wherein said substantially Y-shaped slot includes a central opening that is centered on the intersection of the centerlines of each leg of said substantially Y-shaped slot, said central opening being defined by a circle having a radius that is less than the length of each of said legs of said substantially Y-shaped slot.

* * * * *